United States Patent [19]

Miles et al.

[11] Patent Number: 4,846,848

[45] Date of Patent: Jul. 11, 1989

[54] GASOLINE COMPOSITION

[75] Inventors: Richard Miles, Frodsham, England; Leonard B. Graiff, Houston, Tex.

[73] Assignee: Shell Oil Company, Houston, Tex.

[21] Appl. No.: 190,196

[22] Filed: May 4, 1988

[30] Foreign Application Priority Data

May 8, 1987 [GB] United Kingdom ..... 8710955

[51] Int. Cl.[4] ..... C10L 1/18

[52] U.S. Cl. ..... 44/62; 44/63; 44/72; 585/14

[58] Field of Search ..... 44/62, 63, 72; 585/14

[56] References Cited

U.S. PATENT DOCUMENTS

| | | | |
|---|---|---|---|
| 2,896,593 | 7/1959 | Riemenschneider | 123/1 |
| 3,231,587 | 1/1966 | Rense | 260/346.8 |
| 3,252,771 | 5/1966 | Clough et al. | 44/62 |
| 3,598,551 | 8/1971 | Ek et al. | 44/62 |
| 3,632,510 | 1/1972 | Le Suer | 252/35 |
| 3,749,560 | 7/1973 | Perilstein | 44/80 |
| 3,780,128 | 12/1973 | Shubkin | 585/525 |
| 4,022,590 | 5/1977 | Morduchowitz | 44/80 |
| 4,032,304 | 6/1977 | Dorer et al. | 44/70 |
| 4,132,663 | 1/1979 | Heilman et al. | 252/59 |
| 4,175,926 | 11/1979 | Wisotsky | 44/62 |
| 4,234,435 | 11/1980 | Meinhardt et al. | 252/51.5 |
| 4,357,148 | 11/1982 | Graiff | 44/62 |
| 4,417,082 | 11/1983 | Larkin et al. | 585/12 |
| 4,431,430 | 2/1984 | Sung | 44/53 |
| 4,477,261 | 10/1984 | Sung | 44/63 |
| 4,587,368 | 5/1986 | Pratt | 585/12 |
| 4,728,340 | 3/1988 | Vos | 44/62 |
| 4,765,800 | 8/1988 | Van Es et al. | 44/62 |

FOREIGN PATENT DOCUMENTS

| | | |
|---|---|---|
| 62940 | 10/1982 | European Pat. Off. . |
| 207560 | 1/1987 | European Pat. Off. . |
| 821380 | of 1937 | France . |
| 1597015 | 7/1970 | France . |
| 8500620 | 2/1985 | PCT Int'l Appl. . |
| 1173788 | 12/1969 | United Kingdom . |
| 1287579 | 8/1972 | United Kingdom . |
| 1306233 | 2/1973 | United Kingdom . |
| 1325701 | 8/1973 | United Kingdom . |
| 1483729 | 8/1977 | United Kingdom . |
| 2097814 | 11/1982 | United Kingdom . |
| 2177418 | 1/1987 | United Kingdom . |

OTHER PUBLICATIONS

Campen, M. et al., Hydrocarbon Processing, (Feb. 2, 1982), p. 75.

Campen, M., et al., *Hydrocarbon Processing*, 61, (2), pp. 75–82, Feb. 1982.

*Primary Examiner*—Jacqueline V. Howard

[57] ABSTRACT

Improved gasoline compositions containing a minor amount of a polyalphaolefin having a viscosity at 100° C. from 2 to 20 centistokes, and optionally also an aliphatic polyamine, an alkali or alkaline earth metal salt of a succinic acid derivative, and/or a polyolefin; together with a concentrate for the production of such gasoline composition and a method of operating a spark-ignition engine using such gasoline composition.

20 Claims, No Drawings

GASOLINE COMPOSITION

This invention relates to a gasoline composition comprising a major amount of a gasoline suitable for use in spark-ignition engines and a minor amount of at least one additive.

Numerous deposit forming substances are inherent in hydrocarbon fuels. These substances when used in internal combustion engines tend to form deposits on and around constricted areas of the engine contacted by the fuel. Typical areas commonly and sometimes seriously burdened by the formation of deposits include carburettor ports, throttle body and venturies and engine intake valves.

Deposits adversely affect the operation of the vehicle. For example, deposits on the carburettor throttle body and venturies increase the fuel to air ratio of the gas mixture to the combustion chamber, thereby increasing the amount of unburned hydrocarbon and carbon monoxide discharged from the chamber. The high fuel-air ratio also reduces the gasoline mileage obtainable from the vehicle.

Deposits on the engine intake valves when they get sufficiently heavy, on the other hand, restrict the gas mixture flow into the combustion chamber. This restriction starves the engine of air and fuel and results in a loss of power. Also deposits on the valves can lead to sticking of the valves and can increase the probability of valve failure due to burning and improper valve seating. In addition, these deposits may break off and enter the combustion chamber, possibly resulting in mechanical damage to the piston, piston rings, engine head, etc.

The formation of these deposits can be inhibited as well as removed by incorporating an active detergent into the fuel. Numerous fuel detergents are currently available and many are commercially employed in national brand fuels. These detergents function to varying degrees in cleaning deposit-prone areas of the harmful deposits, thereby enhancing engine performance and longevity.

In addition to having detergent properties, it is an additional advantage of the fuel detergent to have dispersant properties. In the operation of an internal combustion engine, a small amount of the fuel additives inevitably finds access to the crankcase and admixes with the crankcase oil. The continued presence of small amounts of dispersants within the crankcase oil increases the ability of the oil to maintain sludges dispersed. Thus, by developing an additive having both broad range detergency and dispersancy, those parts of the engine contacted by the fuel can be maintained effectively clean and, at the same time, those parts of the engine contacted by the crankcase oil can be maintained with reduced sludge and varnish deposits.

Various materials have been proposed, and used, to provide such detergent/dispersant properties, for example, aliphatic polyamines. Such additives have also been used with polymers of $C_2$ to $C_6$ polyolefins, in particular polyisobutylene, to serve as carrier fluids for the detergent/dispersant, and with salts of succinic acid derivatives to improve flame speed in the cylinder; see, for example, European Patent Applications Nos. 0062940 and 0207560. However, continuous development of engine performance places increasing demands on the efficacy of gasoline additives and there is a continuing need for improvements in additive performance.

It has now been found, and forms the subject of the present invention, that polyalphaolefins form very effective carrier fluids for detergent/dispersant additives for gasoline, being of particular value in minimising the problem of valve sticking which can sometimes occur under low temperature start-up with some polymeric additives. Polyalphaolefins have been recommended for use as synthetic base fluids for engine lubricants (Hydrocarbon processing. Feb. 1982, page 75 et seq.) but hitherto have not been suggested as gasoline additives. Polyalphaolefins (PAO) are hydrogenated oligomers, primarily trimers, tetramers and pentamers, of alphaolefin monomers containing from 6 to 12, generally 8 to 12, carbon atoms. Their synthesis is outlined in the foregoing article in Hydrocarbon Processing, and essentially comprises catalytic oligomerisation of short chain linear alpha olefins (suitably obtained by catalytic treatment of ethylene) followed by hydrogenation. The nature of an individual PAO depends in part on the carbon chain length of the original alphaolefin, and also on the structure of the oligomer. The exact molecular structure may vary to some extent according to the precise conditions of the oligomerisation, which is reflected in changes in the physical properties of the final PAO. Since the suitability of a particular PAO as base lubricating oil is determined primarily by its physical properties, and in particular its viscosity, the various products are generally differentiated and defined by their viscosity characteristics.

According to the present invention, it has been found that polyalphaolefins having a viscosity (measured at 100° C.) from 2 to 20 centistokes are particularly effective as additives for gasoline. In one aspect, the invention therefore provides a gasoline composition comprising a major amount of a gasoline suitable for use in spark-ignition engines, and a minor amount of a polyalphaolefin having a viscosity at 100° C. from 2 to 20, preferably at least 8, centistokes. Such polyalphaolefins are suitably hydrogenated oligomers derived from alphaolefinic monomers containing at least 6, preferably 6 to 24 and especially 8 to 12, carbon atoms. The hydrogenated oligomer itself preferably contains 18 to 80, especially 30 to 80, carbon atoms. The amount of such polyalphaolefin present in the composition is suitably within the range of 100 to 1200 ppmw, especially 200 to 800 ppmw.

In addition to the polyalphaolefin, the gasoline composition may also contain a polyolefin derived from $C_2$ to $C_6$ monomer having a number average molecular weight of from 500 to 1500, preferably 550 to 1000 and especially 600 to 950. The preferred polyolefin is polyisobutylene, and the amount present is suitably such that the polyolefin and polyalphaolefin together are present in an amount of 100–1200 ppmw, the amount of polyalphaolefin normally being greater than the amount of polyolefin.

The gasoline composition preferably contains additionally an oil-soluble aliphatic polyamine containing at least one olefin polymer chain having a molecular weight in the range of from about 500 to about 10,000, especially from 600 to about 1300, attached to the nitrogen and/or carbon atoms of the alkylene radicals connecting the amino nitrogen atoms. Suitably the polyamine is of the formula:

$$\overset{R}{HN}-R'-(HN-R')_X-\overset{R''}{N}-R''$$

wherein R is the polyolefin chain, preferably polyisobutylene of molecular weight from 600 to 1300; R' is an alkylene chain having from 1 to 8, especially 3, carbon atoms; R'' is hydrogen or lower alkyl, especially methyl; and X is 0 to 5, preferably 0.

Further benefits to engine performance are obtained if the gasoline composition additionally contains, as flame speed improver, a minor amount of an alkali metal or alkaline earth metal salt of a succinic acid derivative having as a substituent on at least one of its alpha-carbon atoms an unsubstituted or substituted aliphatic hydrocarbon group having from 20 to 200 carbon atoms, or of a succinic acid derivative having as a substituent on one of its alpha-carbon atoms an unsubstituted or substituted hydrocarbon group having from 20 to 200 carbon atoms which is connected to the other alpha-carbon atom by means of a hydrocarbon moiety having from 1 to 6 carbon atoms, forming a ring structure.

The salts of the succinic acid derivative can be monobasic or dibasic. Since the presence of acidic groups in gasoline is undesirable, it is suitable to apply monobasic salts in which the remaining carboxylic acid group has been transformed into an amide or ester group. However, the use of dibasic salts is preferred.

Suitable metal salts include lithium, sodium, potassium, rubidium, cesium and calcium salts. The effect on the ignition of lean mixtures is greater when alkali metal salts, in particular potassium or cesium salts, are used. Since potassium is more abundant and thus cheaper, salts of this alkali metal are particularly preferred.

The nature of the substituent(s) of the succinic acid derivative is of importance since it determines to a large extent the solubility of the alkali or alkaline earth metal salt in gasoline. The aliphatic hydrocarbon group is suitably derived from a polyolefin, the monomers of which have 2 to 6 carbon atoms. Thus, convenient substituents include polyethylene, polypropylene, polybutylenes, polypentenes, polyhexenes or mixed polymers. Particularly preferred is an aliphatic hydrocarbon group which is derived from polyisobutylene.

The hydrocarbon group may include an alkyl add/or an alkenyl moiety, and may contain substituents. One or more hydrogen atoms may be replaced by another atom, for example halogen, or by a non-aliphatic organic group, e.g. an (un)substituted phenyl group, a hydroxy, ether, ketone, aldehyde or ester. A very suitable substituent in the hydrocarbon group is at least one other metal succinate group, yielding a hydrocarbon group having two or more succinate moieties.

The chain length of the aliphatic hydrocarbon group is also of importance in determining the solubility of the alkali metal salts in gasoline. When chains with less than 20 carbon atoms are used the carboxylic groups and the alkali metal ions render the molecule too polar to be properly dissolvable in gasoline, whereas chain lengths above 200 carbon atoms may cause solubility problems in gasolines of an aromatic type. Accordingly, the carbon chain should contain 20 to 200, preferably 35–150, carbon atoms. When a polyolefin is used as substituent the chain length is conveniently expressed as the number average molecular weight. The number average molecular weight of the substituent, e.g. determined by osmometry, is advantageously from 400 to 2000.

The succinic acid derivative may have more than one $C_{20-200}$ aliphatic hydrocarbon group attached to one or both alpha-carbon atoms, but preferably it has one $C_{20-200}$ aliphatic hydrocarbon group on one of its alpha-carbon atoms and on the other alpha-carbon atom either no substituent or a hydrocarbon of only a short chain length, e.g. $C_1$–$C_6$ group. The latter group can be linked with the $C_{20-200}$ hydrocarbon group, forming a ring structure.

The preparation of the substituted succinic acid derivatives is known in the art. When a polyolefin is present as substituent, the substituted succinic acid salt can conveniently be prepared by mixing the polyolefin, e.g. polyisobutylene, with maleic acid or maleic anhydride and passing chlorine through the mixture, yielding hydrochloric acid and polyolefin-substituted succinic acid, as described in e.g. British patent specification No. 949,981. From the acid the corresponding metal salt can easily be obtained by neutralisation with e.g. metal hydroxide or carbonate.

From e.g. Netherlands patent application No. 7412057 it is known to prepare hydrocarbon-substituted succinic anhydride by thermally reacting a polyolefin with maleic anhydride.

The metal salts of the substituted succinic acids show the desired effect when they are included in the gasoline composition in a very small amount. From an economic point of view the amount thereof is as little as is required to achieve the desired effect. Suitably, the gasoline composition according to the invention contains from 1 to 110 ppmw of the alkali metal or alkaline earth metal present in the alkali metal or alkaline earth metal salt of the succinic acid derivative.

Apart from metal salts of the above-mentioned substituted succinic acids, the gasoline composition may also contain other additives. Thus, it can contain a lead compound as anti-knock additive, and accordingly the gasoline composition according to the invention includes both leaded and unleaded gasoline. When the above-mentioned metal succinates are used in unleaded gasoline it was surprisingly found that the wear, which was expected to occur at the seats of the exhaust valves of the engines, was either reduced considerably or completely absent. The gasoline composition can also contain antioxidants such as phenolics, e.g. 2,6-di-tert-butylphenol, or phenylenediamines, e.g. N,N'-di-secbutyl-p-phenylenediamine, or antiknock additives other than lead compounds, or polyether amino additives, e.g. as described in U.S. Pat No. 4,477,261 and European patent application No. 151,621.

The gasoline composition according to the invention comprises a major amount of a gasoline (base fuel) suitable for use in spark-ignition engines. This includes hydrocarbon base fuels boiling essentially in the gasoline boiling range from 30° to 230° C. These base fuels may comprise mixtures of saturated, olefinic and aromatic hydrocarbons. They can be derived from straight-run gasoline, synthetically produced aromatic hydrocarbon mixtures, thermally or catalytically cracked hydrocarbon feedstocks, hydrocracked petroleum fractions or catalytically reformed hydrocarbons. The octane number of the base fuel is not critical and will generally be above 65. In the gasoline, hydrocarbons can be replaced up to substantial amounts by alcohols, ethers, ketones, or esters. Naturally, the base fuels are desirably substantially free of water, since water may impede a smooth combustion.

The polyalphaolefins can be added as a blend with other chosen additives. A convenient method for preparing the gasoline composition is therefore to prepare a concentrate of the polyalphaolefin together with the other additives, and then to add this concentrate to the gasoline in the amount required to produce the required final concentrations of additives.

The invention accordingly further provides a concentrate suitable for addition to gasoline which comprises a gasoline soluble diluent containing a polyalphaolefin as defined above, an oil-soluble polyamine as defined above, and optionally also a succinic acid derivative salt as defined above and a polyolefin. Suitably, such concentrate contains from 20 to 80% w. of polyalphaolefin and polyolefin, if present; 1 to 30% W of polyamine; and 20 to 50% m of succinic acid derivative salt if present. Suitable gasoline-compatible diluents are hydrocarbons, e.g. heptane, alcohols or ethers, such as methanol, ethanol, propanol, 2-butoxyethanol or methyl tert-butyl ether. Preferably the diluent is an aromatic hydrocarbon solvent such as toluene, xylene, mixtures thereof or mixtures of toluene or xylene with an alcohol. Optionally, the concentrate may contain a dehazer, particularly a polyether-type ethoxylated alkylphenol-formaldehyde resin. The dehazer, if employed, can suitably be present in the concentrate in an amount of from 0.01 to 2% w, calculated on the diluent.

In a further aspect, the invention provides a method for operating a spark-ignition internal combustion engine which comprises introducing into the combustion chambers of said engine a polyalphaolefin-containing gasoline composition as defined above.

The invention is illustrated in the following Examples. In all these Examples, the additives are designated as follows:

(a) "PIB-DAP" is N-polyisobutylene-N',N'-dimethyl-1,3-diaminopropane, the polyisobutylene chain having a molecular weight of 1400;

(b) "PMK" is potassium polyisobutylene succinate in which the polyisobutylene chain has a number average molecular weight of 1050;

(c) "PIB" is polyisobutylene having a number average molecular weight of 650.

(d) "PAO" is a polyalphaolefin, being a hydrogenated oligomer of decene-1 having a viscosity at 100° C. of 8 centistokes.

(e) "HVI 160S" is a straight run mineral base oil having a viscosity of 5 centistokes (at 100° C.).

EXAMPLE

A VW Polo engine, single carburettor, four cylinder, 1.042 litre capacity, compression ratio 9.5:1, was operated for 40 hours on a 4 stage test cycle which comprised running the engine for 0.5 mins at 950 rpm, for 1 minute at 3000 rpm with a load setting of 11.1 Kw, for 1 minute at 1300 rpm with a load setting of 4 Kw, and for 2 minutes at 1850 rpm with a load setting of 6.3 Kw. At the end of the test, the inlet valves of the cylinders were removed and rated visually for cleanliness according to a photographic rating scale based on the CRC (Coordinating Research Council) technique for valve rating (Manual No. 4). This scale provides cleanliness photographs ranging in 0.5 unit intervals from perfectly clean (10.0) to very dirty (5.5). The carburettor was likewise rated for cleanliness on a scale where 10 designates perfectly clean.

A series of 3 tests was carried out using unleaded gasoline (95 ULG) containing PIB-DAP, PMK and either PAO or PAO +PIB. The results of these tests are set out in Table I below.

TABLE I

| Test Run | Additive Conc. ppmw (except PMK) PIB-DAP | PMK ppmwK | PAO | PIB | Inlet Valve Rating | Carburettor Rating |
|---|---|---|---|---|---|---|
| 1 | — | — | — | — | 8.30 | 9.3 |
| 2 | 60 | 16 | 600 | — | 9.34 | 10 |
| 3 | 60 | 16 | 400 | 200 | 9.87 | 10 |

EXAMPLE 2

A Ford Sierra engine, twin carburettor, four cylinder, 1.993 litre capacity, compression ratio 9.2:1, was operated for 41 hours on a 2 stage test cycle which comprised running the engine for 2 minutes at 850 rpm, followed by two minutes at 3000 rpm with a load setting of 18.6 kw. At the end of the test, the inlet valves of the cylinders were removed and rated visually for cleanliness according to a photographic rating scale based on the CRC (Coordinating Research Council) technique for valve rating (Manual No. 4). This scale provides cleanliness photographs ranging in 0.5 unit intervals from perfectly clean (10.0) to very dirty (5.5). The carburettor was likewise rated for cleanliness on a scale where 10 designates perfectly clean.

A series of 7 tests was carried out using gasoline containing 0.15 g/l of lead, 3% v methanol and 2% v TBA, together with the additives designated in Table II below, which lists the results obtained.

TABLE II

| Test Run | Additive Conc. ppmw (except PMK) PIB-DAP | PMK (ppmwK) | PAO | PIB | HVI 160S | Inlet Valve Rating | Carburettor Rating |
|---|---|---|---|---|---|---|---|
| 4 | — | — | — | — | — | 7.35 | 8.90 |
| 5 | 60 | — | — | 400 | — | 8.64 | 9.23 |
| 6 | 30 | 8 | — | 400 | — | 9.00 | 9.40 |
| 7 | 30 | 8 | 300 | — | 100 | 8.93 | 9.90 |
| 8 | 75 | 16 | — | — | 800 | 9.01 | 9.05 |
| 9 | 60 | 16 | 750 | — | — | 9.38 | 9.95 |
| 10 | 60 | 16 | 400 | 200 | — | 9.29 | 9.95 |

We claim:

1. Gasoline composition comprising a major amount of a gasoline suitable for use in spark-ignition engines and a minor amount of a polyalphaolefin having a viscosity at 100° C. from 2 to 20 centistokes, said amount being sufficient to reduce valve sticking under low temperature start-up conditions.

2. Gasoline composition as claimed in claim 1 wherein the polyalphaolefin has a viscosity at 100° C. of at least 8 centistokes.

3. Gasoline composition as claimed in claim 1 or 2 wherein the polyalphaolefin is a hydrogenated oligomer containing 18 to 80 carbon atoms derived from an alphaolefinic monomer containing at least 6 carbon atoms.

4. Gasoline composition as claimed in any one of claims 1 or 2 which contains minor amounts of an oil-soluble aliphatic polyamine, containing at least one olefin polymer chain having a molecular weight in the range from about 500 to about 10,000 attached to nitrogen and/or carbon atoms of the alkylene radicals connecting the amino nitrogen atoms.

5. Gasoline composition as claimed in claim 4 wherein the polyamine has the structural formula:

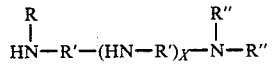

wherein R is a polyolefin chain having a molecular weight of from about 500 to about 10,000; R′ is an alkylene chain having from 1 to 8 carbon atoms; R″ is hydrogen or lower alkyl and X is 0 to 5.

6. Gasoline composition as claimed in claim 5 wherein R is polyisobutylene of molecular weight from about 600 to about 1300 and X is 0.

7. Gasoline composition as claimed in claims 1 or 2 which contains a minor amount of an alkali metal or alkaline earth metal salt of a succinic acid derivative having a polyolefin substituent on at least one of its alpha-carbon atoms.

8. Gasoline composition as claimed in claim 7, in which the dibasic alkali metal salt of the succinic acid derivative is employed.

9. Gasoline composition as claimed in claim 7 or 8 in which the polyolefin is polyisobutylene containing from 35 to 150 carbon atoms in its chain.

10. Gasoline composition as claimed in 1 or 2 which contains additionally a minor amount of polyolefin derived from a $C_2$ to $C_6$ monomer having a number average molecular weight between 500 and 1500.

11. Gasoline composition as claimed in claim 10 wherein the polyolefin is polyisobutylene of molecular weight between 550 to 1000.

12. Gasoline composition as claimed in claim 10 wherein the polyalphaolefin and the polyolefin together are present in an amount of from 100–1200 ppmw, said composition further comprising an oil soluble aliphatic polyamine, containing at least one olefin polymer chain having a molecular weight in the range of from about 500 to about 10,000 attached to nitrogen and/or carbon atoms of the alkylene radical connecting the amino nitrogen atom, present in an amount of from 5 to 200 ppmw, and an alkali metal or alkaline earth metal succinic acid derivative salt, having a polyolefin substitutent on at least one of its alpha-carbon atoms, present in an amount which provides from 1 to 100 ppmw of the alkali or alkaline earth metal.

13. A concentrate suitable for addition to gasoline which comprises a gasoline compatible diluent, a minor amount sufficient to reduce valve sticking under low temperature start-up conditions of a polyalphaolefin having a viscosity at 100° C. from 2 to 20 centistrokes a minor amount of an oil soluble aliphatic polyamine, containing at least one olefin polymer chain having a molecular weight in the range of from about 500 to about 10,000 attached to nitrogen and/or carbon atoms of the alkylene radical connecting the amino-nitrogen atom, and a minor amount of an alkali metal or alkaline earth metal succinic acid derivative salt, having a polyolefin substituent on at least one of its alpha-carbon atoms.

14. A concentrate as claimed in claim 13, wherein the polyalphaolefin and polyolefin are present in an amount of from 20% to 80% w; the polyamine is present in an amount of from 1 to 30% w; and the succinic acid derivative salt is present in an amount of from 20 to 50%w, all percentages being calculated on the diluent.

15. A method for operating a spark-ignition internal combustion engine which comprises introducing into the combustion chambers of said engine a gasoline composition as claimed in claims 1–12.

16. A concentrate according to claim 13 which additionally contains a minor amount of a polyolefin derived from a $C_2$ to $C_6$ monomer having a number average molecular weight between 50 and 1500.

17. A method according to claim 15 wherein the gasoline composition also contains a minor amount of an oil-soluble aliphatic polyamine, containing at least one olefin polymer chain having a molecular weight in the range from about 500 to about 10,000 attached to nitrogen and/or varbon atoms of the alkylene radicals connecting the amino nitrogen atoms.

18. A method according to claim 15 wherein the gasoline also contains a minor amount of an alkali metal or alkaline earth metal salt of a succinic acid derivative having a polyolefin substituent on at least one of its alpha-carbon atoms.

19. A method according to claim 15 wherein the gasoline additionally contains a minor amount of polyolefin derived from a $C_2$ to $C_6$ monomer having a number average molecular weight between 50 and 1500.

20. A method according to claim 15 wherein in the gasoline composition the polyalphaolefin and the polyolefin together are present in an amount of from 100–1200 ppmw, said composition further comprising an oil soluble aliphatic polyamine, containing at least one olefin polymer chain having a molecular weight in the range of from about 500 to about 10,000 attached to nitrogen and/or carbon atoms of the alkylene radical connecting the amino nitrogen atom, present in an amount of from 50 to 200 ppmw, and an alkali metal or alkaline earth metal succinic acid derivative salt, having a polyolefin substituent on at least one of its alpha-carbon atoms, present in an amount which provides from 10 to 100 ppmw of the alkali or alkaline earth metal.

* * * * *